United States Patent [19]

Keeney

[11] Patent Number: 4,553,757

[45] Date of Patent: Nov. 19, 1985

[54] COMBAT SIMULATOR

[76] Inventor: Edward M. Keeney, 120 North St., Monrovia, Calif. 91016

[21] Appl. No.: 573,792

[22] Filed: Jan. 25, 1984

[51] Int. Cl.[4] ..... F41J 9/02

[52] U.S. Cl. ..... 273/369

[58] Field of Search ..... 273/366–370, 273/406; 434/19; 272/54–56; 74/48; 297/260

[56] References Cited

U.S. PATENT DOCUMENTS

| | | | |
|---|---|---|---|
| 518,931 | 4/1894 | Allen | 273/369 |
| 667,592 | 2/1901 | Smith | 273/369 |
| 740,685 | 10/1903 | Needham | 272/54 X |
| 1,655,151 | 1/1928 | Lund | 74/48 |
| 1,927,876 | 9/1933 | Meyer | 273/369 X |
| 1,961,302 | 6/1934 | Powell | 74/48 |
| 2,398,813 | 4/1946 | Swisher | 273/369 |
| 3,297,326 | 1/1967 | Corwin et al. | 273/367 |
| 3,914,879 | 10/1975 | Taylor, III et al. | 434/19 |
| 4,222,564 | 9/1980 | Allen et al. | 273/369 |
| 4,340,370 | 7/1982 | Marshall et al. | 273/369 X |

FOREIGN PATENT DOCUMENTS

| | | | |
|---|---|---|---|
| 1354962 | 2/1964 | France | 74/48 |
| 12118 | of 1891 | United Kingdom | 273/369 |
| 17777 | of 1898 | United Kingdom | 273/369 |
| 119749 | 10/1918 | United Kingdom | 74/48 |

*Primary Examiner*—Paul E. Shapiro

*Attorney, Agent, or Firm*—Christie, Parker & Hale

[57] ABSTRACT

A combat simulator comprising a track, movable between a first inclined position and a second inclined position and a target slidably mounted on the track. The track is moved by a motor having a crank which engages a slot in the track. The motor is activated and deactivated by an ultrasonic motion detector, set to detect motion of a trainee. Two or more combat simulators can be used in tandem to create various situations, including a hostage-suspect situation.

16 Claims, 8 Drawing Figures

Fig. 1
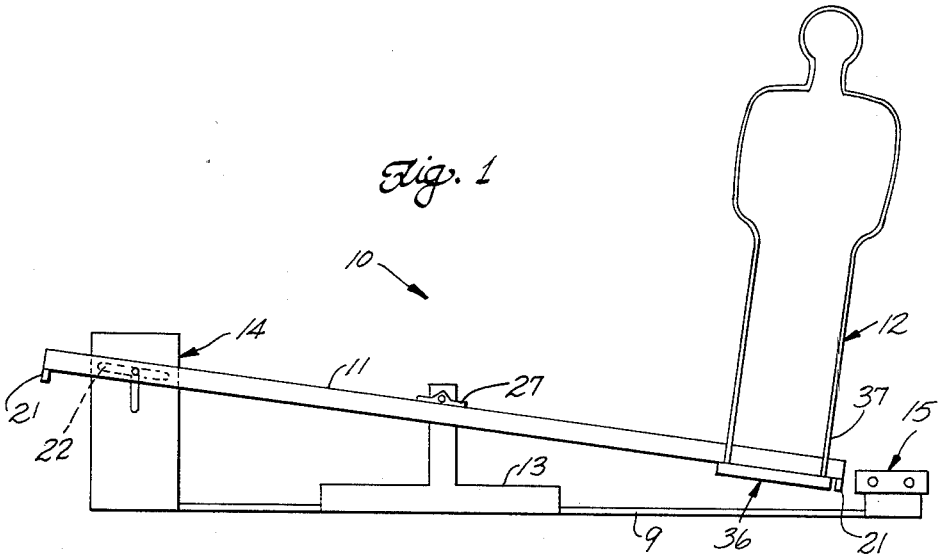
Fig. 2
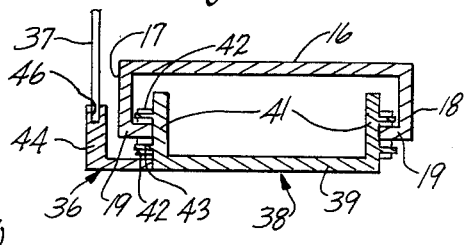
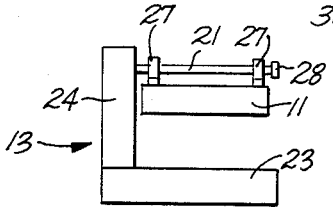
Fig. 3
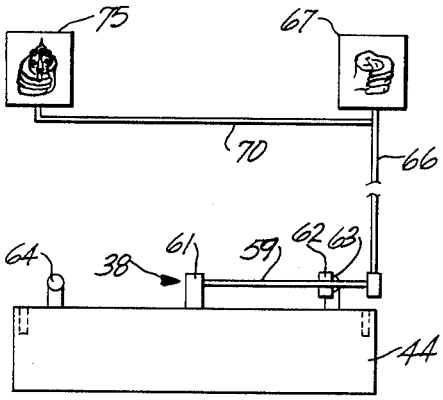
Fig. 7

56
57
15

COMBAT SIMULATOR

FIELD OF THE INVENTION

This invention relates to firearm training systems and more particularly to a device for moving one or more lifelike targets into and out of the view of a trainee.

BACKGROUND OF THE INVENTION

Combat firearm training systems are used by police associations and the like to give trainees experience in combat situations. The object of such a system is generally to present a situation wherein a trainee must decide quickly whether or not to use his firearm. Such situations are often created with the use of lifelike targets, some of which are designed to appear friendly and others of which are designed to appear life-threatening, e.g., a lifelike figure brandishing a firearm. Such targets are typically made to suddenly confront a trainee who must quickly recognize the character of the target and take appropriate action. The sudden appearance can be generated by various means.

U.S. Pat. No. 3,914,879 to Taylor, III, et al described a system using two-dimensional targets which can be rotated to present either a friendly looking figure or a villanous figure. The target is first oriented so that the trainee can see neither figure. The target is then rotated, e.g., by remote control, to present either friend or foe. Typically, several targets are placed at various positions before a trainee and rotated to expose a figure at various time intervals. Such a system can be used to cause a trainee to make several life or death decisions in rapid succession.

One of the drawbacks with the above system is that it lacks realism because live figures cannot suddenly appear from nowhere. Rather, live figures, if they appear suddenly, move into view from behind other objects.

A more realistic system, which is commercially available, comprises motorized figures which move along a track. The figures are controlled remotely by an operator who can, with a sufficiently sophisticated system, move the figures forwardly and rearwardly along the track. With an appropriate shield in place, the figures can be moved from behind the shield into the open and then back behind the shield. This simulates more realistic movement of a person.

The difficulty with such a system is that it is hard for one operator to control the movement of more than one figure. Further, the complex motor mechanism associated with each figure is not only expensive but is subject to breakdown. Another drawback is that such a system requires an operator for controlling movement of the figures along with the trainee.

Thus, there is a continuing need to improve the realism of such systems together with a competing need to reduce their cost.

SUMMARY OF THE INVENTION

The present invention provides a combat simulator in which a lifelike target moves from side to side. Shields can be placed in front of the target so that the target appears to step out from behind a shield and then duck behind it again or behind another shield.

The combat simulator comprises a generally rigid, straight track having first and second ends. The track is movable between a first inclined position wherein the first end is higher than the second end and a second inclined position wherein the first end is lower than the second end.

Reciprocating means are provided for moving the track between the first and second inclined positions. Such reciprocating means can be operated continuously, or preferably can be activated and deactivated remotely. Preferred remote activation and deactivation of a reciprocating means is by one or more ultrasonic motion detectors positioned to detect motion of the trainee at select locations.

A lifelike target slidably engages the track so that the target moves toward the second end of the track when the second end is lower than the first and moves toward the first end when the first end is lower than the second. The track can be positioned below the target or the track can be positioned above the target with the target being suspended from the track.

In a preferred embodiment, the target comprises means for occasionally displaying a weapon, said means being activated at one or both ends of the track by a switch mechanism.

In another preferred embodiment of the invention the target comprises figures on its front and rear sides and can be rotated by a turning means at one or both ends of the track to present a different figure which can appear from behind the shield.

Typically, the trainee in any firearm training system wears headphones to prevent damage to his ears due to the loud noise generated by the gunfire. In another embodiment of the invention, a recording is transmitted to the trainee via the headphones. The recording comprises noise which one would expect to encounter in real life, e.g., street noise, people shouting or screaming, and perhaps even gunfire.

Two or more combat simulators can be used in conjunction, e.g., at spaced-apart locations or, more preferably, one behind the other. In the latter configuration, a hostage situation can be created whereby the forward target is designed to appear like a hostage and the rearward target is designed to look like a suspect. In such an embodiment, the reciprocating means of the two simulator units are adjusted to provide different reciprocating rates so that the hostage does not always appear directly in front of the suspect.

BRIEF DESCRIPTION OF THE DRAWINGS

These and other features and advantages of the present invention will be better understood by reference to the following detailed description when considered in conjunction with the accompanying drawings wherein:

FIG. 1 is a front view of a preferred combat simulator;

FIG. 2 is a transverse cross-sectional view of the track and target carrier;

FIG. 3 is an end view of the combat simulator;

FIG. 7 is a front view of a preferred means for displaying a weapon;

DETAILED DESCRIPTION

Figure 4:
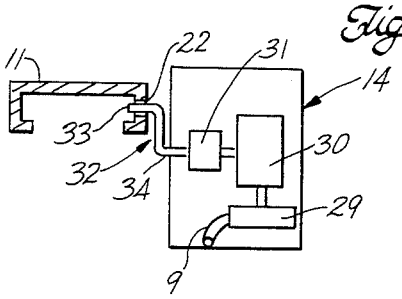
FIG. 4 is a cross-sectional schematic of the track and the reciprocating means.

With reference to FIG. 1, there is shown a preferred combat simulator 10 made in accordance with the present invention. The combat simulator 10 comprises an elongated track 11 on which a target 12 is mounted and afforded slidable movement along the length of the track 11. The track 11 is pivotally mounted on stand 13. A reciprocating means 14 engages and vertically reciprocates the track 11. An ultrasonic motion detector 15 is connected to the reciprocating means by cable 9 and provides a signal for activating and deactivating the reciprocating means 14.

The track 11 is generally straight and made of a rigid material, e.g., aluminum. As shown in FIG. 2, the track 11 has a generally inversed U-shaped transverse cross-section comprising a generally horizontal top wall 16 and generally vertically front and rear side walls 17 and 18 respectively, each having an inwardly projecting flange 19 along their bottom edges. A stop 21 is positioned at each end of the channel, as shown in FIG. 1.

The track 11 further comprises a generally horizontal slot 22 in the rear side wall 18 at a position spaced apart from one end of the track. The slot 22 engages the reciprocating means 14.

At about the midpoint of the track, the track pivotally engages stand 13. With reference to FIG. 3, the stand comprises a large base 23 which rests on the ground, an upright support standard 24 which extends vertically from the base 23 to a position behind and above track 11. A generally horizontal cylindrical support bar 26 extends from the standard 24 over the track 11.

A pair of brackets 27 are fixedly mounted on the top of track 11, e.g., by bolts, welding or the like. Each bracket 27 has a generally cylindrical opening through which the support bar 26 extends. The opening in the brackets 27 are sufficiently large to allow the brackets 27 to rotate and, hence, the track to pivot, on support bar 26. A cap 28 is mounted over the end of the support bar 26 to prevent the support bar from slipping out of brackets 27.

One end of the track is moved up and down by reciprocating means 14. As shown in FIG. 4, the reciprocating means comprises a switch 29, a motor 30, a gear reducer 31 and a crank 32.

In this embodiment, the switch 29 activates the motor 30 in response to a signal received from the motion detector 15 through cable 9 and deactivates the motor 30 when the signal ceases. The motor can be any suitable commercially available motor. Presently preferred motors 30 include automobile windshield wiper motors.

The crank 32 has a crank pin 33 located eccentrically from the crankshaft 34. The crank pin 33 engages slot 22 in track 11. When the crank 32 is rotated by motor 30, the slot 22 and, hence, the end of the track 11 move up and down. Since the track pivots on support bar 26, the entire track 11 moves in a teeter totter fashion.

Again, with reference to FIGS. 1 and 2, the target 12 comprises a target carrier 36 and a wire frame 37 on which clothing, masks, etc., can be mounted to make the target look lifelike. In a particularly perferred embodiment, scoring targets, e.g., bulls-eyes or the like, can be attached, e.g., by clips or clothespins, to the back of the shirt or blouse of the target so that the shirt or blouse does not have to be removed for scoring purposes, i.e., to evaluate the trainee's performance.

The target carrier 36 comprises a generally U-shaped body 38 having a generally horizontal bottom wall 39 and generally vertical front and rear side walls 41. Four pairs of wheels 42, each pair comprising an upper wheel and a lower wheel, are rotatably mounted on pins 43 extending outwardly from each side wall 41.

The target carrier further comprises a generally L-shaped holder 44 for the wire frame. The wire frame holder 44 is rigidly attached to the bottom wall 39 of the carrier body 38. The holder 44 has a vertical hole 46 at each end in which the bottom ends of the wire frame 37 can be inserted.

The width of the body 38 of the target carrier 36 is smaller than the width of the track 11 and is mounted inside the track 11 with the flanges 19 of the track 11 interposed between the wheels 42 of each wheel pair, i.e., the upper wheel of each wheel pair above the flange 19 and the lower wheel is below the flange 19.

In this arrangement, when the track 11 is pivoted so that one end is higher than the other end, the target 12 rolls along flange 19 downwardly to the lower end of the track 11 until it engages the stop 21 at that end. When the track 11 is pivoted so that the opposite end is higher, the target rolls to that opposite end until it engages the stop 21 at that end. Having wheels 42 above and below flange 19 prevents the target from tilting as it rolls along the inclined track 11.

The reciprocating means 14 are activated and deactivated by the ultrasonic motion detector 15. Commercially available ultrasonic motion detectors can be used such as the Ultrasonic Motion Sensor Alarm System No. 49303 sold by Radio Shack, a division of Tandy Corp. When motion is detected, the ultrasonic motion detector 15 sends a signal to the switch 29 of the reciprocating means 14 which in turn activates the motor 30. When motion ceases, i.e., no motion is detected, the signal from the ultrasonic motion detector 15 ceases and the switch 29 deactivates motor 30, the target sliding to whichever end of the tract is lowest. The speed of the target is thus dependent on the degree of incline of the track when it stops. In this arrangement, movement of the target is generated only by the movement of the trainee that is detected by the ultrasonic motion detector 15. A plurality of ultrasonic motion detectors can be used to detect motion in various areas. Further, the target can be activated by motion of the instructor if desired.

Figure 5:
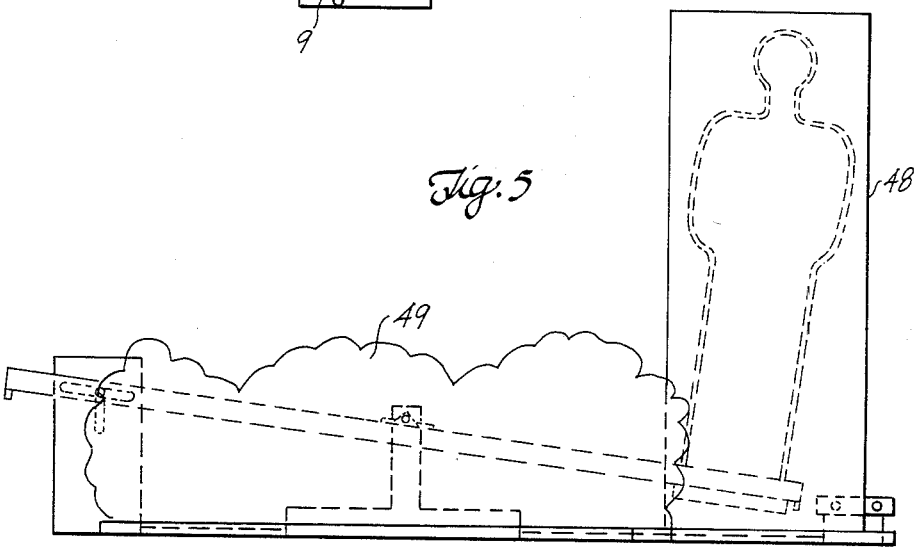
FIG. 5 is a front view of a combat simulator comprising shields.

With reference to FIG. 5, in a particularly preferred embodiment of the invention, end shields 48 are placed in front of either or both ends of track 11. The end shields 48 are sufficiently large to obscure the targets from view when the targets are at the ends of the track. The end shields 48 are preferably made to appear as a realistic object, e.g., a wall, house etc. This realistically simulates a suspect hiding behind a known object.

A lower middle shield 49, e.g., made to appear as shrubbery or the like, is placed in front of the track 11 and stand 13 so that the trainee cannot anticipate movement of the targets by watching the track 11 pivot. The middle shield 49 is made of a bullet-proof material to protect the combat simulator behind it from occasional low shots by the trainee.

Figure 6:
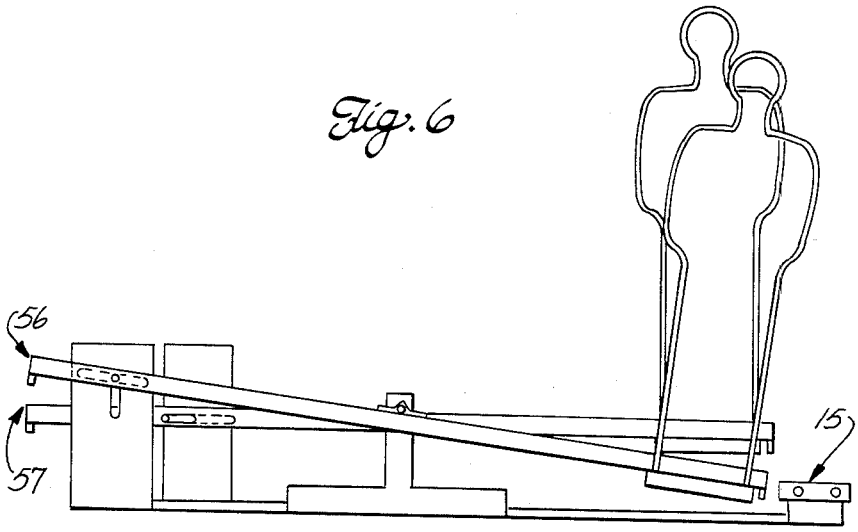
FIG. 6 is a front view of two combat simulators used in combination.

In another particularly preferred embodiment of the invention, shown in FIG. 6, two combat simulators are used in combination. In such an embodiment, it is preferred that one simulator be a master control unit 56 and the other a slave unit 57. The master control unit 56 is generally as described above. The slave control unit 57 differs from the master control unit in that it has no independent ultrasonic motion detector and the reciprocating means does not comprise a switch for activating and deactivating the motor. The motor of the reciprocating means of the slave unit 57 is controlled by the switch of the reciprocating means of the master control unit 56. In this manner, the motors of both the master control unit 56 and the slave control unit 57 are activated simultaneously.

It is preferred that the motor of the reciprocating means of the slave unit 57 be adjusted, e.g. by a rheostat so that the speed of the motor of the slave unit 57 differs from that of the control unit 56. Such an arrangement is preferred so that the movement of the slave unit target does not identically mimic that of the control unit target.

In the arrangement shown, the target of the forwardly positioned master control unit can be dressed to appear as a hostage and the target of the rearward slave unit can be dressed to appear as a suspect, thereby creating a realistic hostage-suspect situation.

In another particularly preferred embodiment of the invention, the target is equipped with means for displaying either a weapon held in its hand or an "open" hand, i.e., a hand not carrying a weapon, when the target comes into view of the trainee.

In this embodiment, the means for displaying either a weapon or an open hand comprises a switch mechanism 58. With reference to FIG. 7, the switch mechanism 58 comprises a lever arm 59 which is pivotally mounted at one end on a pin 61 extending upwardly from the wire frame holder 44 of the target carrier 36, generally at about the midpoint of the holder 44.

The lever arm 59 comprises a lever arm magnet 62 at a position along its length spaced apart from the pin 61. A first carrier magnet 63 is fixedly mounted at one end of the frame holder 44 at a position spaced apart from the pin 61 a distance about equal to the distance between the pin 61 and the first magnet 62. A second carrier magnet 64 is fixedly mounted to the other end of the holder 44 about the same distance away from the pin 61.

The lever arm 59 is afforded pivotal movement between a first position wherein the lever arm magnet 62 abuts the first carrier magnet 63 and a second position wherein the lever arm magnet 62 abuts the second carrier magnet 64. In the first position, the attractive forces between the lever arm magnet 62 and the first carrier magnet 63 maintains the lever arm in that position until the lever arm is "jarred" away from the first carrier magnet. This would occur when the target carrier rolls to one end of the track and is caused to stop abruptly by the stop 21. When the target carrier rolls to and engages the stop 21 at the opposite end of the track, the lever arm pivots back to the first position. It is preferred that the attractive forces between the magnets be sufficient so that the lever arm does not change position every time the target carrier engages a stop.

The lever arm 59 extends from pin 61 a distance sufficient that the end of the lever arm 59 opposite the pin 61 is directly below the "arms" of the target when the lever arm is in the first and second positions. A rod 66 is fixedly attached to the end of the lever arm 59 and extends upwardly to the elevation of the hand of the target.

A card 67 is mounted on the rod 66. The card has a drawing of an "open" hand on one side and a drawing of a hand carrying a weapon on the other side. When the lever arm 59 is in the first position, the card 67 is at the location of one "hand", e.g., the right hand, of the target. When the lever arm 59 is in the second position, the card is at the location of the other "hand", e.g., the left hand, of the target. The card 67 is oriented on rod 66 so that, when the lever arm 59 is in either the first or second position, one side of the card 67 is facing the trainee.

A curved, generally horizontal rod 70 can extend from card 67 to the other side of the target. A second card 75 having drawings of "open" hands on both sides of rod 70 is provided to prevent the trainee from anticipating that every time a card is on one particular side of the target, it will be displaying a weapon.

When used in conjunction with a second combat simulator in a "hostage-suspect" arrangement, the trainee must not only decide whether the target is suspect or hostage, but whether the suspect is armed.

A similar switch mechanism can be used to reverse the wire frame of the target. In such an arrangement, the wire frame can be dressed to give the appearance of a friend on one side and a foe on the other. Thus the trainee could not even anticipate what type of target will appear from behind the end shield on a particular track.

Figure 8:
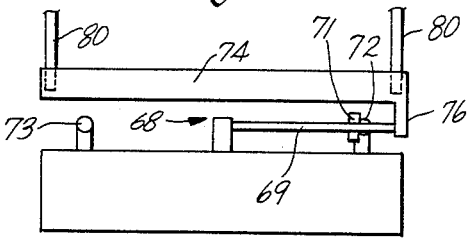
FIG. 8 is a front view of a preferred means for reversing the target.

With reference to FIG. 8, the switch mechanism 68 used in this embodiment comprises a pivot arm 69 having a pivot arm magnet 71 which engages magnet 72 or 73 on frame holder 44. A generally horizontal auxillary frame holder 74 is rigidly attached at one end to the end of the pivot arm by extension 76.

The auxillary frame holder 74 is oriented generally parallel to the lever arm 69 so that in the first position of the lever arm 69, i.e., with magnets 71 and 72 engaged, one side of the target frame 80 faces the trainee. In the second position, i.e., with magnets 71 and 73 engaged, the other side of the target frame 80 faces the trainee.

As in the weapon simulator means, the lever arm 69 switches position when the target carrier rolls toward the end of the track 11 with sufficient momentum and is stopped suddenly by stop 21.

With any of the above embodiments, it is preferred that the trainee be presented with environmental sounds which are transmitted to the trainee through headphones. The environmental sounds such as street noises, e.g., traffic noises, as well as sounds from bystanders or sounds from the suspect and/or hostage, provide realistic distractions to the trainee.

The preceding description has been presented with reference to the preferred embodiments of the invention shown in the accompanying drawings. Workers skilled in the art and technology to which this invention pertains will appreciate that alterations and changes in the described apparatus and structures can be practiced without meaningfully departing from the principles, spirit and scope of this invention.

For example, the track need not pivot like a teeter totter, rather, it could pivot at one end if desired. Rather than rolling over a track positioned below the target, the target could be suspended from a track.

Although an ultrasonic motion detector is the presently preferred means for activating and deactivating the reciprocating means, the reciprocating means could operate continuously or be remotely operated by, for example, a hand-held "off-on" switch or by a radio transmitter operated by someone other than the trainee. In such an embodiment, the switch of the reciprocating means would activate and deactivate the motor according to the signal received from the "on-off" switch or the radio transmitter.

It is equally apparent that multiple simulators can be used in arrangemenets other than the "hostage-suspect" arrangement described.

Further, the track and shields, if used, can be made of multiple components to facilitate storage and transport. For example, the end shields can simply be formed by a frame with a flexible material stretched across the frame. The frame can be disassembled and the material folded or rolled up.

Accordingly, the foregoing descriptions should not be read as pertaining only to the precise structures and apparatus described, but rather should be read consistent with and as support for the following claims which are to have their fullest fair scope.

What is claimed is:

1. A firearm training device comprising:

a track having first and second ends, said track being pivotally movable between the first inclined position wherein the first end is higher than the second end and a second inclined position wherein the first end is lower than the second end;

reciprocating means for moving the track between the first and second inclined positions; and a lifelike target slidably engaging said track so that when the first end of the track is higher than the second end, the target moves toward the second end, and when the first end of the track is lower than the second end, the target moves toward the first end, said target comprising a weapon simulator which comprises:

a two-sided representation in which one side generates the appearance of a hand holding a gun and the other side generates the appearance of an empty hand, said representation being positioned at an elevation to simulate a hand of the target; and switch means for reversing said representation.

2. A firearm training device as claimed in claim 1 further comprising at least one stationary shield which can be mounted in front of the track, said shield being sufficiently large to hide the target from view when viewed from in front of the shield.

3. A firearm training device as claimed in claim 1 further comprising means for remotely activating and deactivating the reciprocating means.

4. A firearm training device as claimed in claim 3 wherein the means for activating and deactivating the reciprocating means comprises an ultrasonic motion detector which activates the reciprocating means when motion is detected and deactivates the reciprocating means when the detection of motion ceases.

5. A firearm training device as claimed in claim 1 wherein the track is below the target and the target comprises a target carrier for rolling along the length of the track.

6. A firearm training device as claimed in claim 1 wherein the track is positioned above the target and the target is suspended from the track.

7. A firearm training device as claimed in claim 1 wherein the switch means comprises:

a generally horizontal lever arm having first and second ends pivotally mounted at the first end to the target carrier and comprising a lever arm magnet at a position spaced apart from the first end, said lever arm being afforded pivotal movement between a first position wherein the second end of the lever arm is below one arm of the target and a second position wherein the second end of the lever arm is below the other arm of the target;

a first carrier magnet fixedly attached to the target carrier at a location adjoining the lever arm magnet when the lever arm is in the first position for maintaining the lever arm in the first position by attraction to the lever arm magnet;

a second carrier magnet fixedly attached to the target carrier at a location adjacent the lever arm magnet when the lever arm is in the second position for maintaining the lever arm in the second position by attraction to the lever arm magnet;

a generally vertical rod attached at its lower end to the second end of the lever arm and attached at its upper end to the representation; and wherein the lever arm switches from the first to the second position when the carrier suddenly ceases sufficiently rapid movement in one direction and the lever arm switches from the second to the first position when the carrier suddenly ceases sufficiently rapid movement in the other direction.

8. A firearm training device as claimed in claim 1 wherein the target comprises two sides, each side having a separate appearance and wherein the device further comprises means for rotating the target beween a first position wherein one side faces the viewer and a second position wherein the other side faces the viewer.

9. A firearm training device comprising:

a track having first and second ends, said track being pivotally movable between a first inclined position wherein the first end is higher than the second end and a second inclined position wherein the first end is lower than the second end;

reciprocating means for moving the track between the first and second inclined positions;

a target comprising a wire frame on which clothes and a mask can be mounted to give a lifelike appearance and a target carrier on which the wire frame can be mounted, said target carrier slidably engaging said track so that when the first end of the track is higher than the second end, the target moves toward the second end, and when the first end of the track is lower than the second end, the target moves toward the first end; and an ultrasonic motion detector for activating the reciprocating means when motion is detected and deactivating the reciprocating means when the detection of motion ceases.

10. A firearm training device as claimed in claim 9 further comprising stationary shields which can be mounted in front of the ends of the track, said shields being sufficiently large to hide the target from view when viewed from in front of the shield.

11. A firearm training device as claimed in claim 9 wherein the target comprises a weapon simulator comprising:

a two-sided representation in which one side generates the appearance of a hand holding a gun and the other side generates the appearance of an empty hand, said representation being positioned at an elevation to simulate a hand of the target; and switch means for reversing said representation comprising:

a generally horizontal lever arm having first and second ends pivotally mounted at the first end of the target carrier and comprising a lever arm magnet at a position spaced apart from the first end, said lever arm being afforded pivotal movement between a first position wherein the second end of the lever arm is below one arm of the target and a second position wherein the second end of the lever arm is below the other arm of the target;

a first carrier magnet fixedly attached to the target carrier at a location adjoining the lever arm magnet when the lever arm is in the first position for maintaining the lever arm in the first position by attraction to the lever arm magnet;

a second carrier magnet fixedly attached to the target carrier at a location adjacent the lever arm magnet when the lever arm is in the second position for maintaining the lever arm in the second position by attraction to the lever arm magnet;

a generally vertical rod attached at its lower end to the second end of the lever arm and attached at its upper end to the representation; and wherein the lever arm switches from the first to the second position when the carrier suddenly ceases sufficiently rapid movement in one direction and the lever arm switches from the second to the first position when the carrier suddenly ceases sufficiently rapid movement in the other direction.

12. A firearm training device as claimed in claim 9 further comprising means for transmitting environmental sounds to a trainee.

13. A firearm training system comprising a master control unit and at least one slave unit, each comprising:

a track having first and second ends, said track being pivotally movable between a first inclined position wherein the first end is higher than the second end and a second inclinded position wherein the first end is lower than the second end;

reciprocating means for moving the track between the first and second inclined positions;

a lifelike target slidably engaging said track so that when the first end of the track is higher than the second end, the target moves toward the second end, and when the first end of the track is lower than the second end, the target moves toward the first end;

wherein the master control unit further comprises a switch for simultaneously activating and deactivating the reciprocating means for each unit; and wherein the firearm training system further comprises an ultrasonic motion detector for sending a signal to the switch when motion is detected and wherein the switch activates the reciprocating means when the signal from the ultrasonic motion detector is received and deactivates the reciprocating means when the signal from the ultrasonic motion detector ceases.

14. A firearm training system as claimed in claim 13 wherein each unit has a separate and distinct rate of reciprocation.

15. A firearm training device comprising:

a track having first and second ends, said track being pivotally movable between the first inclined position wherein the first end is higher than the second end and a second inclined position wherein the first end is lower than the second end;

reciprocating means for moving the track between the first and second inclined positions;

a lifelike target slidably engaging said track so that when the first end of the track is higher than the second end, the target moves toward the second end, and when the first end of the track is lower than the second end, the target moves toward the first end; and means for activating and deactivating the reciprocating means comprises an ultrasonic motion detector which activates the reciprocating means when motion is detected and deactivates the reciprocating means when the detection of motion ceases.

16. A firearm training system comprising:

a stationary stand;

a generally flat track having first and second ends mounted at its midpoint on the stand and afforded pivotal movement between a first inclined position wherein the first end is higher than the midpoint and a second inclined position wherein the second end is higher than the midpoint, said track comprising a slot along at least a portion of the length of the track at a location spaced apart from the midpoint of the track;

a motor having a rotatable drive shaft;

a switch for activating and deactivating the motor;

a crank having a crank shaft which is connected to the drive shaft of the motor and a crank pin located eccentrically from the crank shaft which slidably engages the slot in the track so that when the crank is rotated by the motor, the track is caused to reciprocate between its first and second inclined positions;

a target slidably engaging said track so that when the track is in the first inclined position, the target moves toward the second end of the track, and when the track is in the second inclined position, the target moves toward the first end; and an ultrasonic motion detector for sending a signal to the switch when motion is detected and wherein the switch remotely activates the motor when the signal from the ultrasonic motion detector is received and deactivates the motor when the signal from the ultrasonic motion detector ceases.

* * * * *